United States Patent [19]

Fukuda et al.

[11] Patent Number: 4,816,184

[45] Date of Patent: Mar. 28, 1989

[54] ELECTRICALLY CONDUCTIVE MATERIAL FOR MOLDING

[75] Inventors: Masao Fukuda, Moka; Tsutae Fujiwara, Tochigi, both of Japan

[73] Assignee: General Electric Company, Pittsfield, Mass.

[21] Appl. No.: 16,829

[22] Filed: Feb. 20, 1987

[51] Int. Cl.[4] ..... H01B 1/06

[52] U.S. Cl. ..... 252/511; 252/512; 252/518; 252/519; 252/503; 252/506; 252/508; 523/137; 428/375

[58] Field of Search ..... 252/506, 511, 512, 518, 252/519; 523/137; 264/105, 149, 174; 524/495, 496, 439, 401; 428/363, 364, 368, 372, 373, 374, 375, 379, 383, 388

[56] References Cited

U.S. PATENT DOCUMENTS 4,530,779 7/1985 Mayama et al. ..... 255/511

FOREIGN PATENT DOCUMENTS 0117700 9/1984 European Pat. Off. .
22710A 7/1982 Japan .
296066A 6/1985 Japan .
983140 2/1965 United Kingdom .

*Primary Examiner*—Josephine Barr

[57] ABSTRACT

Electrically conductive material for molding in the form of pellets. The electrically conductive material is a thermoplastic synthetic resin having electrically conductive agents embedded therein and having electrically conductive fibers continuously extending from one end of the pellet to the other end of the pellet. The electrically conductive fibers are localized in the core part of the pellet and are covered with the thermoplastic synthetic resin containing the electrically conductive agents which may be electrically conductive powders, electrically conductive flakes, electrically conductive short fibers and mixtures thereof.

5 Claims, 1 Drawing Sheet

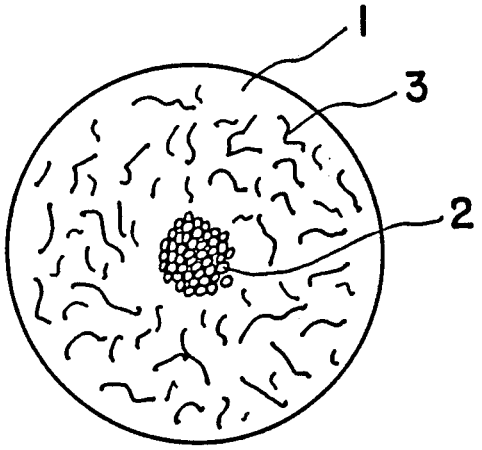
1
3
2

ELECTRICALLY CONDUCTIVE MATERIAL FOR MOLDING

FIELD OF THE INVENTION

This invention relates to electrically conductive materials for molding to give the molded articles which are excellent in electromagnetic wave shielding effect.

BACKGROUND OF THE INVENTION

It has been desired to produce housings of electronic appliances which have a property of shielding electromagnetic waves to reduce electromagnetic interference. To this end, coating with electroconductive paints, attachment of metal flakes and admixtures of conductive agents into moulding materials are known. Among these methods, the last method is believed to be of practical use to attain a high level of electromagnetic shielding effectiveness with ease. As a way of performing this method where an electroconductive agent is admixed into a moulding material, it is known to uniformly mix short metal fibers or metal flakes with thermoplastic resins in a kneader or an extruder, extrude them into pellets and then shape them into an article. Some shielding materials having this configuration are available in the market, for instance, polybutylene terephthalate compounded with 40% by weight by nickel coated mica, and high impact polystyrene compounded with 8 to 16% by weight of stainless steel chopped fibers. However, moulded articles from these materials exhibit a poor volumetric resistivity of the order of 1 ohm cm. Volumetric resistivity is a measure of the shielding effectiveness and is determined in the method which will be stated below. In another manner, a synthetic resin is used to coat the continuous filaments of carbon fibers having metal plating or vapor deposited metal coating on the surface and this is cut into pellets having a desired size (Japanese Patent Application Laying-Open Sho-59-22710/1984). Molded articles produced from this type of pellets containing, for instance, 20% by weight of nickel coated carbon fibers, have an improved volumetric resistivity of the order of $10^{-2}$ ohm cm according to our measurement, but this value is not always satisfactory. Further, conductive material for moulding which contains master pellets and natural pellets, wherein the master pellets contain long stainless steel (SUS 304) fibers in the core and the natural pellets contain no conductive fillers (Japanese Patent Application Laying-Open Sho-61-296066/1986). The above article indicates that a molded article from this material exhibits the highest shielding effect, i.e., 48 dB, at 100 MHz and 16 dB at 1000 MHz. These values are not satisfactory.

BRIEF DESCRIPTION OF THE INVENTION

In the pellets containing admixed conductive agents for use in the production of molded articles having the electromagnetic shielding effect, it has now been found that the electromagnetic shielding effect of the molded articles is remarkably improved by using pellets having the particular configuration in that the continuous conductive fibers are collectively located in the core of the pellet and small conductive powders, flakes or short fibers are uniformly dispersed in a resin surrounding the continuous conductive fibers. In other words, when a given amount of conductive agents is contained in pellets, the shielding effect is highly enhanced by unevenly distributing a part of the conductive agents in a form of continuous fiber in the core of the pellets and uniformly dispersing the remaining part of the conductive agents in a form of small powder, small flakes or short fibers, compared to the case where all of the conductive agents are localized in the core part of the pellet or all of the conductive agents are, in contrast, uniformly dispersed in the pellet resin.

The present invention provides an electrically conductive molding material in a form of pellets composed of a thermoplastic synthetic resin and electrically conductive agents embedded in the resin, characterized in that the electrically conductive fibers continuously extending from one end of the pellet to the other end of the pellet are localized in the core part of the pellet, and the fibers are covered with thermoplastic synthetic resin containing electrically conductive powders, flakes and/or short fibers in a uniformly dispersed state.

BRIEF DESCRIPTION OF THE DRAWING

The accompanying drawing is a schematic side view of the conductive moulding material according to the invention.

DETAILED DESCRIPTION OF THE INVENTION

The accompanying drawing shows the circular cut end of a cylindrical pellet according to the invention. Numeral 1 represents a thermoplastic synthetic resin; 2, a number of conductive fibers continuously extending from the shown side of the pellet to the other side; and 3, conductive short fibers uniformly distributed in thermoplastic synthetic resin 1.

Conductive powders or flakes may be used instead of the conductive short fibers indicated by numeral 3 in the drawing.

The thermoplastic synthetic resin may be any resins that are usually used in molding, such as polyamides, polyethers, polycarbonates, polyethera, polyolefins, polystyrene resins and vinyl resins, but are not limited to these.

As the continuous conductive fibers, they may be named metal fibers such as copper wire and stainless steel wire, or fibers coated with metal such as carbon or glass fibers plated with metal or coated with deposited metal. The length of the fibers is mostly the same as the length of the pellet and is typically 2 to 15 mm, particularly 3 to 7 mm.

As the conductive powders, they may be named powders of metal such as copper, stainless steel, zinc and ferrite, and powders of mica or glass beads plated with metal or coated with deposited metal. As the conductive flakes, they may be named metal flakes such as aluminum flakes. As the conductive short fibers, they may be named those composed of the same materials as stated in relation with the continuous conductive fibers. In a pellet, the short fibers and the continuous fibers may be of the same materials or different materials. The length of the short fibers may be, for instance 0.1 to 3 mm, preferably 1 to 2 mm. A combination of two or more out of the aforesaid powders, flakes and short fibers may also be used in the invention.

The weight ratio of the continuous conductive fibers to conductive powders, flakes and short fibers ranges typically from 9:1 to 1:9, particularly from 7:3 to 3:7, depending on each material, but is not limited to these and may properly be decided to comply with a desired level of shielding effect.

It is preferred that the total weight of the conductive materials in the pellet including the continuous fibers, the conductive powders, flakes and short fibers amounts to 5 to 60% by weight of the total weight of the whole pellet.

The electrically conductive molding material according to the invention may further contain other additives such as pigments, flame retardants, releasing agents and so on.

The present material for molding may be prepared in the following manner. The thermoplastic synthetic resin and conductive powders, flakes and/or short fibers and, if desired, other additives are supplied to an extruder such as one conventionally used for wire coating, and are uniformly mixed at a temperature above a melting point of the resin. Then, the resulting mixture is coated on the continuous conductive filaments. The resultant continuously coated material is cut in a desired length to form pellets. The peripheral shape of the side section of the pellet may be circular or any optional figures. The material for molding according to the invention may be melted and molded in conventional molding methods, where the continuous fibers localized at the core part of the pellet are dispersed in a molded product.

If pellets are prepared by mixing a resin and relatively long fibers having the length of the pellet together with small powders, flakes or short fibers to substantially uniformly disperse relatively long fibers in pellet, then many of the relatively long fibers will be cut short by the shearing force during the mixing, which results in deterioration of the shielding effect. Of course, the relatively long fibers in the present invention are somewhat cut when the pellets are molded into an article. However, it is meaningful to avoid the breakage of the long fibers during the vigorous and prolonged mixing at the stage of the preparation of pellets.

The material for molding of this invention gives molded articles which have an unexpectedly high shielding effect to electromagnetic waves. With a given amount of electrically conductive agents, the present invention yields remarkably improved shielding effectiveness compared to the conventional techniques. In the material for molding according to the invention, the comparatively long conductive fibers and the small conductive powders, flakes or short fibers are contained separately and, when the material is molded into an article, these long conductive fibers and small conductive fillers are mixed together. It is believed that such a unique configuration that these conductive agents having different shapes, i.e., long fibers and small powders, flakes or short fibers, are evenly mixed together contributes to the improved shielding effect of the present invention. This is surprising because it has been believed that a greater aspect ratio (ratio of length to diameter) of a conductive filler will yield better shielding effect. The small powders, flakes and short fibers used in the invention have, of course, small aspect ratios.

The invention will further be explained in the following examples which are not restrictive.

In the examples, volumetric resistivity is determined as follows:

A rectangular bar having the length of 5.0 cm and the cross-sectional area 0.806 $cm^2$ ($1.27 \times 0.635$ cm) is prepared as a specimen. First, its electrical resistance in lengthwise is measured, say X ohm. Then, this X ohm is multiplied by the volume and divided by the cross-sectional area of the specimen to obtain the volumetric resistivity expressed in ohm cm. In an actual measurement, three such specimens are made from a bar having a length over 15 cm and the average of the three readings is used as a volumetric resistivity.

Attenuation of electromagnetic waves is determined on a moulded plate of 3 mm in thickness according to a conventional manner.

EXAMPLE 1

Noryl ® (composed of polyphenyleneoxide and polystyrene, Engineering Plastics Co. Ltd.) was used in the amount of 70 parts by weight as the thermoplastic synthetic resin. Noryl ® is a registered trademark of General Electrical Company.

Five parts by weight of stainless steel short fibers (diameter 30 micron, length 1.6 mm) were uniformly mixed with the resin at a temperature of 310 C, which was then coated on to 25 parts by weight of continuous copper filaments (each filament's diameter 50 micron). Accordingly, the total amount of the conductive materials was 30 parts by weight. The resultant coated wire (diameter 3 mm) was cut in 7 mm of length to obtain a conductive material for molding of the invention.

The obtained pellets were molded into a bar, from which three test pieces were prepared as stated above, and evaluated for volumetric resistivity. The range of the measured volumetric resistivity is as shown in Table 1.

COMPARISON EXAMPLE 1

Thirty (30) parts by weight of copper short fibers (diameter 50 micron, length 4 mm) were used instead of the stainless steel short fibers and the continuous copper fibers. Thus, the amount of the conductive fillers was same as in Example 1.

The pellets were prepared by compounding of Noryl ® and the above copper short fibers.

The measured volumetric resistivity is as shown in Table 1.

COMPARISON EXAMPLE 2

Thirty (30) parts by weight of continuous copper filaments (each filament's diameter 50 micron) were used instead of the stainless steel short fibers and the continuous copper fibers. Seventy (70) parts by weight of Noryl ® without conductive material was coated on to the above copper filaments and cut into pellets. The measured volumetric resistivity is as shown in Table 1.

TABLE 1

| | Volumetric Resistivity (ohm cm) |
|---|---|
| Example 1 | 0.0015 to 0.0020 |
| Comparison Example 1 | about 0.040 |
| Comparison Example 2 | 0.0035 to 0.0075 |

It can be seen from Table 1 that the volumetric resistivity of the pellets according to the invention is decreased by one order from that of Comparison Example 1 where no continuous filaments were used, and one half to one fourth of that of Comparison Example 2 where no small conductive fillers were used.

EXAMPLE 2

The procedure of Example 1 was followed using 25 parts by weight of the continuous copper filaments and 5 parts by weight of short brass fibers (length 1.5 mm).

The volumetric resistivity is 0.0015 ohm cm. The attenuation of electromagnetic waves is as follows:

| Frequency (MHz) | dB Electric Wave | dB Magnetic Wave |
|---|---|---|
| 100 | 71 | 47 |
| 200 | 68 | 52 |
| 300 | 61 | 58 |
| 400 | 56 | 62 |
| 500 | 52 | 50 |
| 600 | 53 | 46 |
| 700 | 41 | 35 |
| 800 | 30 | 35 |
| 900 | 31 | 35 |
| 1000 | 22 | 34 |

EXAMPLE 3

The procedure of Example 1 was followed using 23 parts by weight of the continuous copper fibers and 2 parts by weight of short stainless steel fibers.

The volumetric resistivity is 0.002 ohm cm. The attenuation of electromagnetic waves is as follows:

| Frequency (MHz) | dB Electric Wave | dB Magnetic Wave |
|---|---|---|
| 100 | 69 | 38 |
| 200 | 60 | 42 |
| 300 | 55 | 47 |
| 400 | 50 | 65 |
| 500 | 45 | 40 |
| 600 | 40 | 32 |
| 700 | 33 | 24 |
| 800 | 25 | 27 |
| 900 | 19 | 22 |
| 1000 | 11 | 16 |

COMPARISON EXAMPLE 3

Fifty (50) parts by weight of Noryl® and 50 parts by weight of short brass fibers (length 1.5 mm) were compounded and formed into pellets. Thus, no continuous filaments were used.

The volumetric resistivity is as high as 0.05 ohm cm. The measured attenuation of electromagnetic waves is as shown in the following table. It can be seen that the attenuation is poor though an extremely large amount of the conductive filler was used.

| Frequency (MHz) | dB Electric Wave | dB Magnetic Wave |
|---|---|---|
| 100 | 61 | 24 |
| 200 | 52 | 34 |
| 300 | 37 | 42 |
| 400 | 44 | 52 |
| 500 | 39 | 52 |
| 600 | 35 | 40 |
| 700 | 29 | 35 |
| 800 | 24 | 38 |
| 900 | 15 | 35 |
| 1000 | 11 | 29 |

We claim:

1. An electrically conductive material for molding in the form of pellets comprising a thermoplastic synthetic resin and electrically conductive agents embedded in the resin, and having electrically conductive fibers continuously extending from one end of the pellet to the other end of the pellet, the electrically conductive fibers being localized in the core part of the pellet, and being covered with thermoplastic synthetic resin containing electrically conductive agents selected from the group consisting of electrically conductive powders, flakes, short fibers and mixtures thereof in uniformly dispersed state.

2. The electrically conductive material according to claim 1, wherein the continuously extending conductive fibers are metal fibers or metal coated fibers of 2 to 15 mm in length.

3. The electrically conductive material according to claim 1, wherein the conductive powders, flakes or short fibers are of metal, metal coated carbon or metal coated glass fibers, the short fibers being 0.1 to 3 mm in length.

4. The electrically conductive material according to claims 1, 2, 3 or 5, wherein the weight ratio of the continuously extending conductive fibers to the conductive powders, flakes, short fibers or mixtures thereof, ranges from 9:1 to 1:9.

5. The electrically conductive material according to claim 2, wherein the conductive powders, flakes or short fibers are of metal, metal coated carbon or metal coated glass fibers, the short fibers being 0.1 to 3 mm in length.

* * * * *